United States Patent [19]

Hamann

[11] Patent Number: 4,491,097

[45] Date of Patent: Jan. 1, 1985

[54] CRANK GUIDE ASSEMBLY FOR AN INTERNAL COMBUSTION ENGINE WITH AT LEAST TWO FACING CYLINDERS

[75] Inventor: Lutz Hamann, Assling, Fed. Rep. of Germany

[73] Assignee: Ficht GmbH, Kirchseeon, Fed. Rep. of Germany

[21] Appl. No.: 494,768

[22] Filed: May 13, 1983

[30] Foreign Application Priority Data

May 14, 1982 [DE] Fed. Rep. of Germany ..... 3218339

[51] Int. Cl.[3] ..... F02B 75/28

[52] U.S. Cl. ..... 123/56 R; 123/56 AC; 123/56 BC; 123/197 AC; 123/197 AB

[58] Field of Search ..... 123/197 A, 197 AC, 197 AB, 123/197 R, 56 R, 56 A, 56 AC, 56 B, 56 BC, 56 C, 55 AA, 55 A

[56] References Cited

U.S. PATENT DOCUMENTS 1,432,041 10/1922 Scott ..... 123/56 BC
4,013,048 3/1977 Reitz ..... 123/56 BC

*Primary Examiner*—Craig R. Feinberg
*Assistant Examiner*—David A. Okonsky
*Attorney, Agent, or Firm*—Toren, McGeady and Stanger

[57] ABSTRACT

A crank guide assembly for an internal combustion engine with facing cylinders includes a crank guide defining an opening with a pair of opposed long sides and a pair of opposed short sides extending between the long sides. The long sides guide the sliding piece on a crankshaft. A replaceable base plate is mounted on each of the long sides and locking plates, disposed parallel to the short sides, hold the base plates on the long sides.

8 Claims, 1 Drawing Figure

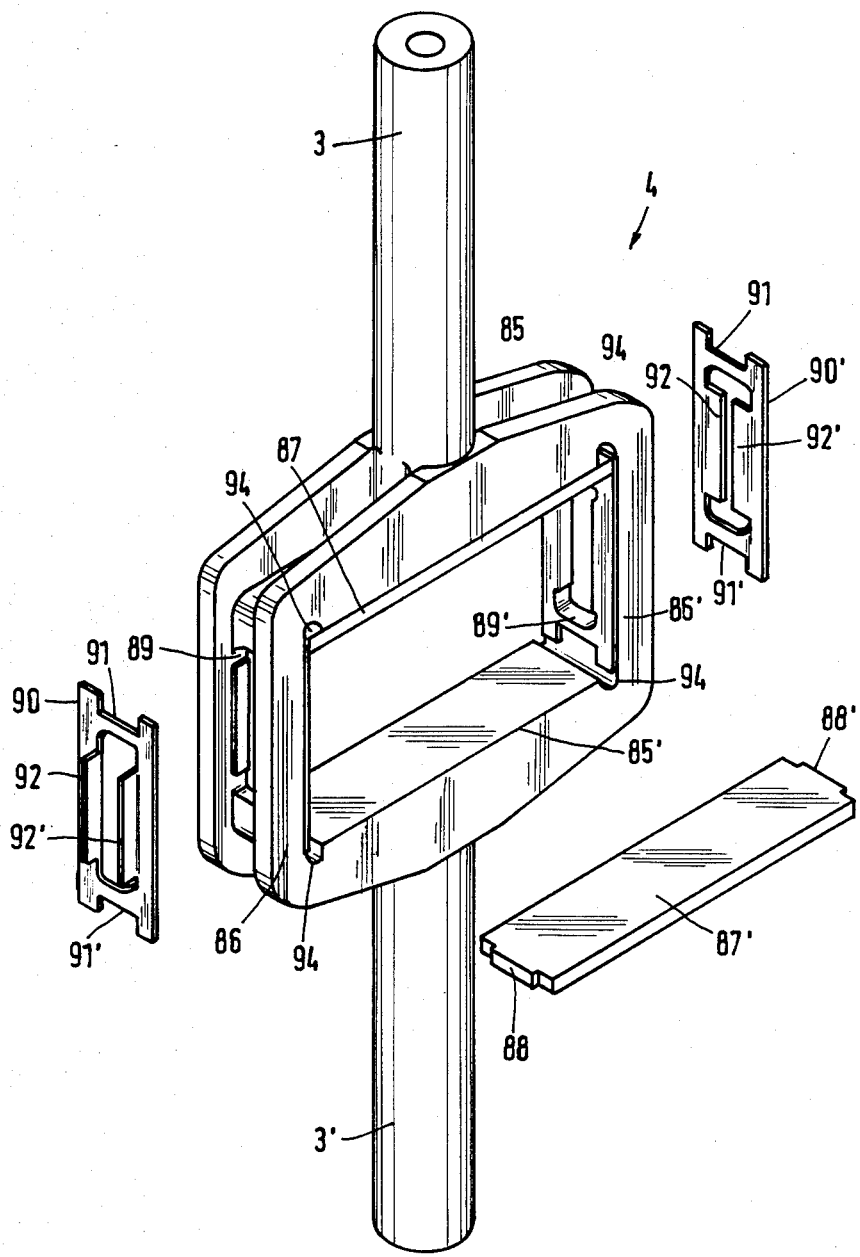
3
4
91
85
94
92
90'
92'
87
94
91'
89'
86'
91
89
94
90
88'
85'
92
92'
91'
86
94
87'
88
3'

CRANK GUIDE ASSEMBLY FOR AN INTERNAL COMBUSTION ENGINE WITH AT LEAST TWO FACING CYLINDERS

SUMMARY OF THE INVENTION

The present invention is directed to a crank guide assembly for an internal combustion engine with at least two facing cylinders for converting reciprocating piston movements into a rotary movement with the aid of a sliding piece arranged on a crankshaft guided in the crank guide assembly. The crank guide assembly is of the general type disclosed in German Patent No. 409 919.

Reciprocating piston-type engines generally use a simple crank gear with oscillating connecting rods for converting the linear movements of the working pistons into the rotary movement of the crankshaft. Although modern crank-type engines have achieved high standards of construction and have been manufactured in the millions, they still have certain deficiencies. Accordingly, due to the very nature of the crank gear, as a result of the finite length of the connecting rod joining the piston and the throw of the crankshaft, normal forces act on the piston and reduce the useful life of the piston, the piston ring and the cylinder running surfaces. These normal forces acting at right angles to the piston's running direction and changing direction once by 180° during one revolution of the crankshaft, not only cause wear of the cylinder running surfaces, but also lead to increased frictional forces which impair the efficiency of such engines.

As illustrated in the above-mentioned German Patent No. 409 919, the crank gear rotating between the two facing piston cylinder units leads to an infinitely long connecting rod and the receiprocating crank guide also assumes the linear guidance and the support of the forces and moments which occur with respect to the engine crankcase. Therefore, such a crank guide frame is highly mechanically stressed and its sliding surfaces guiding the sliding piece are subject to considerable wear.

Consequently, there is a need for a crank guide assembly in which the bearing surfaces guiding the sliding piece can be easily replaced.

Therefore, it is the primary object of the present invention to provide a crank guide assembly which makes it possible in a very simple and operationally reliable manner to detachably connect the parts guiding and supporting the sliding piece in the crank guide. In accordance with the present invention, the crank guide is provided with two pairs of opposed sides with a base plate replaceably mounted on each of one pair of the sides. Locking plates extend along the other pair of sides between the base plates and secure the base plates in position. Additional features of the invention are set forth in the claims.

As a result of the construction of the crank guide assembly in accordance with the invention, the gas and/or oil volumes displaced by the reciprocating sliding piece can escape from the crank guide assembly region and the particularly highly stressed parts, that is the surfaces guiding the sliding piece, are provided as replaceable base plates and they are formed of a suitable bearing material and can be ground in a plane-parallel manner. After the base plates are inserted into the crank guide, they are secured in position by locking plates and the locking plates are then secured by bending two tongues on each locking plate through 90°. To replace the base plates, it is only necessary to bend the tongues back into their original position and then remove the locking plates. Obviously, new locking plates must be used when new base plates are installed.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

BRIEF DESCRIPTION OF THE DRAWING

The drawing is a perspective view of a crank guide assembly embodying the present invention with certain of the assembly parts shown in an exploded arrangement.

DETAIL DESCRIPTION OF THE INVENTION

In the drawing the crank guide assembly includes a crank guide 4 defining a generally rectangular opening having a pair of opposed or facing long sides 85, 85' and a pair of opposed or facing short sides 86, 86' extending between the long sides. A piston rod 3, 3' is fixed to each of the long sides 85, 85'. The piston rods extend substantially perpendicularly to the long sides.

A base plate 87, 87' is positioned on each of the long sides 85, 85'. The base plates 87, 87' are formed from a suitable bearing metal and have the same width as the crank guide. Base plate 87 is shown mounted or supported against the long side 85 while the other base plate 87' is shown spaced outwardly from its associated long side 85'. The base plates 87, 87' are ground in a plane-parallel manner. Each of the base plates has a pair of long sides and a pair of short sides and a projection 88, 88' extends outwardly from each short side.

A pair of locking plates 90, 90', formed as stamped metal parts, each have a length and width corresponding to the length and width of the short sides 86, 86' of the crank guide 4. The short sides at the opposite ends of each locking plate have a recess 91, 91' with a shape which corresponds to the length and width of the projections 88, 88' on the base plates 87, 87'. In the stamping of each locking plate, a pair of tongues 92, 92' are provided so that the approximately H-shaped contour of the locking plate is slotted in a double headed T-shaped manner with the web of the double headed T-slot being located on an imaginary symmetrical line of the locking plates. As can be seen in the drawing, the locking plate on the right-hand side has the tongues 92, 92' located in the plane of the plate while the locking plate 90 on the left-hand side of the drawing shows the tongues 92, 92' bent through 90°. With the locking plates inserted between the base plates so that they secure the base plates in place against the long sides 85, 85', the tongues are bent outwardly into openings 89, 89' formed in the short sides of the opening in the crank guide 4. With the tongues 92, 92' bent outwardly the locking plates are secured in place and, in turn, secure the base plates.

To facilitate the insertion of the base plates and the locking plates in the opening in the crank guide, and to be better able to control stress concentrations during load reversals, semi-circular recesses 94 are formed at the intersection of the long and short sides within the opening in the crank guide 4. The recesses 94 extend for the entire length of the crank guide as can be seen in the drawing.

The openings 89, 89' extending through the short sides 86, 86' of the crank guide ensure that there is no efficiency loss due to compression action. Such an efficiency loss would occur if the reciprocating sliding block would force the gas and/or oil volume against the closed narrow sides 86, 86' of the crank guide. Due to the location of the openings 89, 89', the gas and/or oil volumes displaced by the reciprocating sliding piece can escape from the crank guide region and particularly from the highly stressed parts, that is the replaceable base plates.

While specific embodiments of the invention have been shown and described in detail to illustrate the application of the inventive principles, it will be understood that the invention may be embodied otherwise without departing from such principles.

I claim:

1. Crank guide assembly for an internal combustion engine with two opposed cylinders for converting reciprocating piston movements into rotary movement with the aid of a sliding piece arranged on a crankshaft and guided in said crank guide assembly, comprising a crank guide, said crank guide defining an opening having a pair of spaced facing first sides and a pair of spaced facing second sides with each of said first sides and second sides having opposite ends and each said second side extending between one opposite end of each of said first sides, a base plate replaceably mounted in the opening in said crank guide for guiding the sliding piece and each said base plate supported on a different one of said first sides, each said base plate having opposite ends extending into juxtapositon with the opposite ends of each said second side located at the opposite ends of said first side on which said base plate is supported, each said second side having an opening located therethrough and the opening in each said second side of said crank guide defines a passageway from the opening in said crank guide for permitting the flow therethrough of fluid volumes out of the opening in said crank guide.

2. Crank guide assembly, as set forth in claim 1, wherein a locking plate is mounted on and extends along each of said second sides with each said locking plate having a pair of opposite ends located adjacent the opposite ends of said second side on which it is located and the opposite ends of each said locking plate interengaging said base plates located at the opposite ends of said second side on which said locking plate is mounted, and said locking plates arranged to hold said base plates in engagement with the corresponding said first sides.

3. Crank guide assembly, as set forth in claim 2, wherein said first sides are longer than said second sides, and a piston rod secured through each of said longer first sides and said piston rod extending perpendicularly outwardly from said first side.

4. Crank guide assembly, as set forth in claim 2, wherein each said locking plate is a stamped metal part having an approximately H-shaped outside contour and an imaginary symmetric line extending between the opposite ends of said locking plate, an approximately double-headed T-shaped slot formed in each said locking plate disposed symmetrically of the imaginary symmetric line of said locking plate.

5. Crank guide assembly, as set forth in claim 4, wherein the opening in each of said second sides of said crank guide is elongated in the direction extending between the first sides of said crank guide and said T-shaped slot in said locking plate extends in the elongated direction of the opening, each said locking plate having a planar surface extending generally parallel with the surface of the corresponding said second side defining the opening in said crank guide, and said tongues on said locking plate being displaceable out of the planar surface of said locking plate through 90° into contact with the surfaces of said second plate defining the opening in the corresponding second side of said crank guide.

6. Crank guide assembly for an internal combustion engine with two opposed cylinders for converting reciprocating piston movements into a rotary movement with the aid of a sliding piece arranged on the crank shaft, comprising a crank guide defining a rectangular opening arranged to receive the sliding piece with the rectangular opening having a pair of oppositely disposed and spaced first sides and a pair of oppositely disposed and spaced second sides with each of said first and second sides having opposite ends and with each said second side extending between one of the opposite ends of each of said first sides, a base plate replaceably mounted on each of said first sides and having a pair of opposite ends located at the opposite ends of the corresponding said first side, a locking plate replaceably engageable with each of said second sides and each said locking plate having opposite ends each located at the opposite end of the corresponding said second side and interengaging one opposite end of each said base plate located at the adjacent end of said first side between which the corresponding said second side extends for holding said base plates against said first sides of the opening in said crank guide, each of the opposite ends of each said base plate has rectangularly shaped projections extending outwardly therefrom, each of the opposite ends of each said locking plate has rectangularly shaped recesses corresponding to the shape of said projections on said base plates so that each said recess receives and interengages one said projection for holding said base plates against the first sides of the opening in said crank guide, each of said second sides of said crank guide have an opening extending therethrough elongated in the direction of said second side extending between said first sides, and each said locking plate having tongues formed therein displaceable into engagement with the corresponding said second sides along the surfaces of the opening in the corresponding said second side.

7. Crank guide assembly, as set forth in claim 6, wherein each said locking plate has an H-shaped outside contour, and an elongated double-headed T-shaped slot formed symmetrically in each said locking plate with said slot having an elongated stem part extending in the direction of said second side extending between said first sides and a head part at each of the opposite ends of the elongated stem part extending across the elongated direction of the stem part, and said tongues being defined by the parts of said locking plate extending along the stem part between the head parts.

8. Crank guide assembly, as set forth in claim 7, wherein the opening through said crank guide having corners defined by the juxtaposed opposite ends of said first and second sides and each said corner having a semi-circular recess communicating with the opening and extending through said crank guide for facilitating assembly and disassembly of said base plates and locking plates within the opening in said crank guide.

* * * * *